US006929594B2

(12) United States Patent
Delisle

(10) Patent No.: US 6,929,594 B2
(45) Date of Patent: Aug. 16, 2005

(54) BELT DRIVE ASSEMBLY FOR FEEDING ZIPPER TAPE

(75) Inventor: Victor Delisle, Roswell, GA (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 10/261,479

(22) Filed: Sep. 30, 2002

(65) Prior Publication Data

US 2004/0063558 A1 Apr. 1, 2004

(51) Int. Cl.[7] ..... B31B 1/90
(52) U.S. Cl. ..... 493/212; 493/214
(58) Field of Search ..... 53/412, 133.4, 53/139.2; 493/212, 213, 214, 927

(56) References Cited

U.S. PATENT DOCUMENTS 5,400,568 A 3/1995 Kanemitsu et al. ..... 53/412
5,776,045 A * 7/1998 Bodolay et al. ..... 493/215
5,987,856 A * 11/1999 Lerner ..... 53/479
6,131,370 A * 10/2000 Ausnit ..... 53/412
6,195,967 B1 * 3/2001 Todd et al. ..... 53/562
6,244,021 B1 * 6/2001 Ausnit et al. ..... 53/412
6,553,740 B2 * 4/2003 Delisle ..... 53/133.4
6,568,150 B2 * 5/2003 Forman ..... 53/133.4
6,574,939 B1 * 6/2003 Heijnen et al. ..... 53/133.4
6,588,176 B1 * 7/2003 Buchman ..... 53/412
6,588,177 B1 * 7/2003 Melchoir ..... 53/412

* cited by examiner

*Primary Examiner*—Eugene Kim
(74) *Attorney, Agent, or Firm*—Ostrager Chong Flaherty & Broitman P.C.

(57) ABSTRACT

A method and an apparatus for automatically feeding zipper assemblies (with or without sliders) to a station, for example, a station where the zipper assemblies are sealed to thermoplastic bag making film. The zipper tape feeding apparatus comprises a pair of endless belts that circulate in opposite directions and have confronting portions running along a straight pathway through which a zipper tape is passed. The first belt is driven intermittently by a motor and the second belt is free to circulate during frictional contact with the first belt. At least a portion of the zipper tape is sandwiched between confronting portions of the belts, being moved forward as the belts circulate. The belts are preferably made of rubber to minimize slippage of the zipper tape during feeding.

19 Claims, 6 Drawing Sheets

BELT DRIVE ASSEMBLY FOR FEEDING ZIPPER TAPE

BACKGROUND OF THE INVENTION

The present invention relates to methods and apparatuses for automated manufacture of a reclosable plastic package having a resealable closure, especially as part of a form, fill and seal process. In particular, the invention relates to methods and apparatuses for manufacturing reclosable plastic packages and bags having a zipper installed in the mouth of the package.

In the use of plastic bags and packages, particularly for foodstuffs, it is important that the bag be hermetically sealed until the purchaser acquires the product, takes it home, and opens the bag or package for the first time. It is then commercially attractive and useful for the consumer that the bag or package be reclosable so that its contents may be protected. Flexible plastic zippers have proven to be excellent for reclosable bags, because they may be manufactured with high-speed equipment and are reliable for repeated reuse.

A typical zipper comprises one fastener strip or member having a groove and attached to one side of the bag mouth, and another fastener strip or member having a rib and attached to the other side of the bag mouth, which rib may interlock into the groove when the sides of the mouth of the bag are pressed together. Alternatively, a fastener strip having a plurality of ribs may be on one side of the bag mouth, while a fastener strip having a plurality of grooves or passageways may be on the other side, the ribs locking into the passageways when the sides of the mouth of the bag are pressed together. In the latter case, there may be no difference in appearance between the two fastener strips, as the ribs may simply be the intervals between passageways on a strip that may lock into another of the same kind. In general, and in short, some form of male/female interengagement is used to join the two sides of the bag mouth together. The fastener strips or members are bonded in some manner to the material from which the bags themselves are manufactured.

In the automated manufacture of plastic reclosable packages or bags, it is known to feed a zipper assembly to a position adjacent a sheet of thermoplastic film and then attach the zipper assembly to the bag by means of heat sealing. The zipper assemblies are attached at spaced intervals along the thermoplastic sheet, one zipper assembly being attached to each section of film respectively corresponding to an individual package or bag. The zipper assembly consists of two interlocking fastener strips that, in the final package, lie inside the mouth of the package. Each fastener strip preferably has a flange that extends toward the product side of the package in a direction transverse to the line of the zipper. In accordance with one known method of feeding zipper assemblies to an automated form, fill and seal machine, the zipper assembly is in the form of a tape that is unwound from a spool for automated feeding. The tape comprises a continuous length of interlocked fastener strips. The continuous tape is fed to a cutting device that cuts the tape at regular lengths to form an individual zipper. Each individual zipper is attached to the thermoplastic film by heat sealing or other suitable means.

Prior to cutting and heat sealing, the zipper tape, with or without sliders, must be automatically positioned correctly relative to the thermoplastic film. Moving the zipper tape into position overlying the thermoplastic film requires an automated feeding device. In cases where the bag making film and the zipper tape are stopped during sealing of the zipper tape to the bag making film, the zipper tape feeding apparatus must operate intermittently.

There is a need for methods and apparatus for feeding a zipper tape, with or without sliders, to a desired position overlying the bag making film without slippage of the zipper tape.

BRIEF DESCRIPTION OF THE INVENTION

The present invention is directed to a method and apparatus for automatically feeding zipper tape a station where it can be sealed to bag making film. In the embodiments disclosed herein, the zipper tape feeding apparatus comprises a pair of opposed circulating belts, one belt being driven intermittently by a motor and the other belt being free to circulate during frictional contact with the driven belt and a zipper tape that is sandwiched between the confronting portions of the belts. The belts are preferably made of a material, e.g., rubber, that minimizes slippage of the zipper tape during feeding. In an exemplary application of the invention, a zipper tape feeding apparatus may be placed between a slider insertion station and a zipper sealing station. The latter can be combined with a vertical form-fill-seal (FFS) machine, in which case the zippers are applied to the film in a direction transverse to the running direction of the bag making film.

One aspect of the invention is an apparatus comprising first and second multi-pulley assemblies, first and second belts respectively encasing the first and second multi-pulley assemblies and comprising mutually confronting portions, and a zipper tape comprising at least a portion trapped between the confronting portions of the first and second belts.

Another aspect of the invention is an apparatus for feeding a zipper tape comprising first and second circulating belts, the first belt being arranged to circulate along a first pathway comprising a first generally straight path segment, and the second belt being arranged to circulate along a second pathway comprising a second generally straight path segment, wherein the first and second generally straight path segments lie parallel and adjacent to each other, the first and second belts moving in the same direction along the first and second generally straight path segments during belt circulation. The zipper tape comprises first and second profiled closure members that are interlocked to each other, and first and second zipper flanges respectively connected to the first and second profiled closure members, the first and second zipper flanges confronting each other. The first and second belts cause a portion of the zipper tape trapped therebetween to move in the same direction as the belts move along the respective straight path segments during belt circulation.

A further aspect of the invention is an apparatus comprising first and second belts arranged with respective portions confronting each other, each of the first and second belts having a respective endless groove formed therein. The endless grooves are aligned with and confront each other along the confronting portions of the first and second belts, thereby forming a passageway.

Yet another aspect of the invention is an apparatus comprising: first and second belts arranged with respective portions confronting each other at an interface; and a zipper tape comprising first and second profiled closure members that are interlocked to each other, and first and second zipper flanges respectively connected to the first and second profiled closure members, the first and second zipper flanges confronting each other, respective portions of the first and second zipper flanges being disposed between and in contact with respective first portions of the confronting portions of the first and second belts, while the first and second profiled closure members lie outside of the confronting portions of the first and second belts.

Another aspect of the invention is a method of feeding zipper tape comprising the following steps: arranging first and second belts for circulation along first and second paths respectively, respective mutually opposing first portions of the first and second belts being in contact along a generally straight path segment; placing a portion of a zipper tape between and in contact with respective mutually opposing second portions of the first and second belts, the zipper tape portion being disposed parallel to the generally straight path segment; and driving the first belt to circulate in a predetermined direction with sufficient friction between the first belt and contacting portions of the zipper tape and the second belt that the second belt circulates in a direction opposite to the predetermined direction and the zipper tape is advanced.

Other aspects of the invention are disclosed and claimed below.

DETAILED DESCRIPTION OF THE INVENTION

Figure 1:
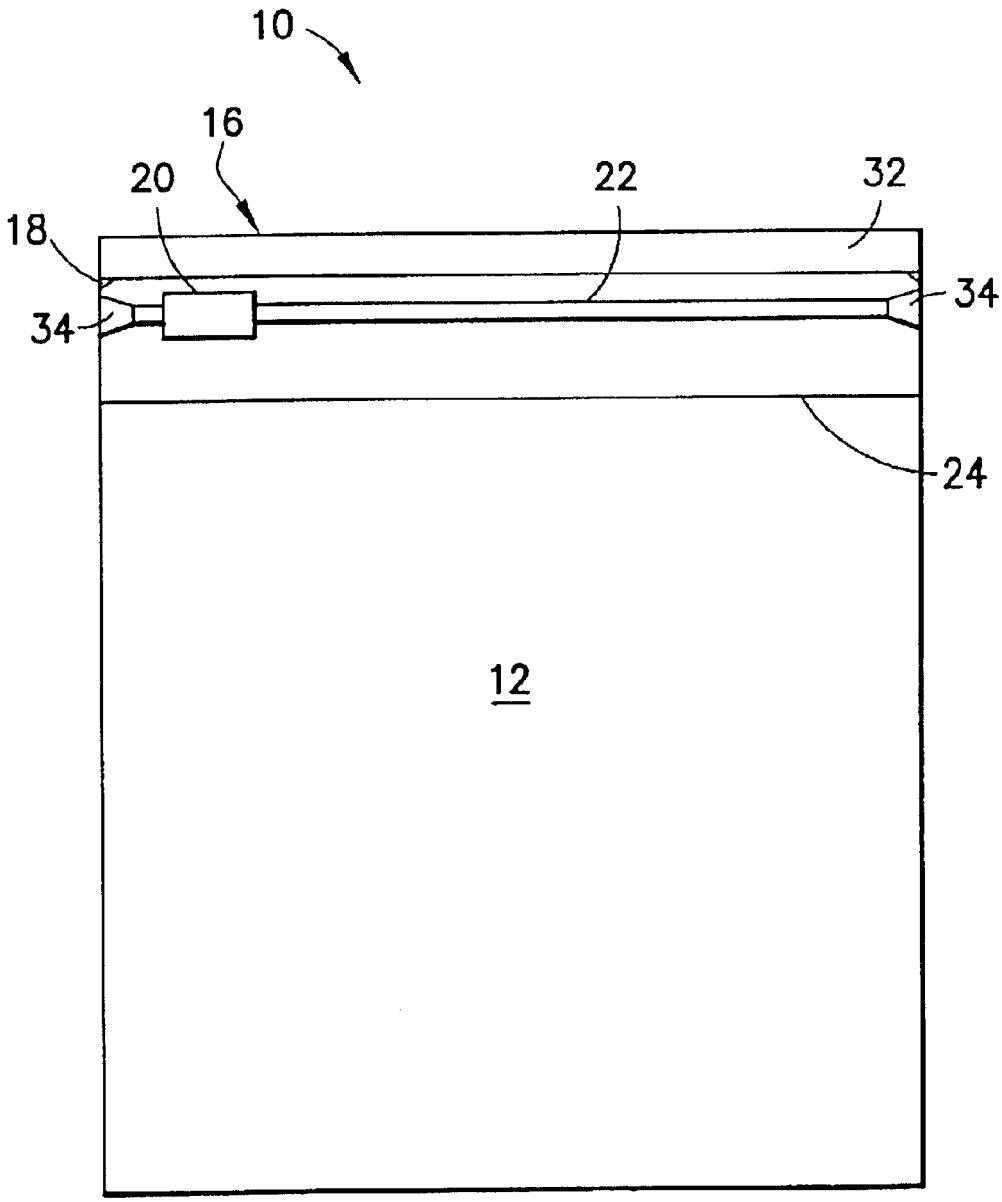
FIG. 1 is a drawing showing a front view of a conventional reclosable package having a slider-zipper assembly installed in the mouth of the package.

The present invention can be utilized in conjunction with many different methods of packaging product in a reclosable plastic package or bag. In particular, the invention has application in automated lines or machines which form a package, fill it with product, and then seal the product inside the package using a known form-fill-seal (FFS) methods. Although embodiments of the invention are disclosed below with reference to systems that apply zippers to bag making film in a direction transverse to the running direction of the film (i.e., the machine direction), the invention may be employed in other types of systems as well. For example, the zipper tape drive assembly could be used to feed zipper tape to a sealing station in the machine direction.

A typical zipper designed for use with a slider comprises a pair of zipper flanges that extending below the profiled closure members are sealed to the bag making film. A typical zipper designed for use without a slider comprises interlocking profiled closure members with dual flanges that respectively extend above and below the closure members. The upper flanges serve as pull flanges for opening the zipper by grasping, while the lower flanges are sealed to the bag making film.

In a typical form-fill-seal operation, a continuous supply of thin packaging or bag making film is paid off of a supply reel by a suitable mechanism. For example, the FFS machine may be provided with feed drive rollers for pulling the film through the FFS machine. For each length of bag making film corresponding to an individual package, a zipper assembly is attached to the film. The zipper may be laid directly on the film, but preferably is fed laterally across the upper surface of the film at right angles to the longitudinal edges of the film or, in other words, at right angles to the longitudinal formation axis of the film. The zippers are cut off from the end of a zipper tape that is paid out from a zipper tape supply reel and guided to a sealing and cutting station, where an individual zipper is cut and sealed to the bag making film. The length of each zipper segment will be less than one-half of the film width. Typically, a flange on one side of the zipper is sealed to the film at a sealing station in advance of the FFS machine. The lateral portions of the film beyond the ends of the attached zipper are sufficiently long so that they can eventually be folded over and sealed to the other zipper flange at the end of the FFS machine.

Reference will now be made to the drawings in which similar elements in different drawings bear the same reference numerals.

FIG. 1 depicts a reclosable package having a slider-operated zipper. The package 10 comprises a receptacle with a mouth at the top, the receptacle being formed by a front wall 12 and a rear wall (not shown) that is opposite to the front wall. The front and rear walls are typically formed from clear thermoplastic film heat sealed as necessary to form hermetically sealed junctures for the various portions of the package, e.g., along the sides if folded along the bottom or along a central seam and along the bottom if folded along the sides. A zipper 22 comprising a pair of fastener strips having respective interlockable profiled closure members is provided in the mouth of the receptacle, attached to the front wall 12 and rear wall. A slider 20 is provided on the zipper to facilitate its opening and closing. FIG. 1 shows the slider 20 in a position corresponding to closure of the zipper 22. Moving the slider 20 toward the right-hand side would disengage the interlockable members of the zipper and moving the slider back to the closed position shown in FIG. 1 brings the interlockable members of the zipper into full engagement once again. For proper functioning, the interlockable members have spot seals or ultrasonic stomps 34 at the ends of the zipper tapes. These seals ensure that the zipper segments will not come apart during use and provide end stops for stopping the slider 20.

Prior to opening of the package by the consumer, the slider-zipper assembly may be covered on the consumer side by an enclosed header 16 that is hermetically sealed. The sealed header 16, which provides a tamper-evident feature, comprises front and rear panels that may be integrally formed with or heat sealed to the front and rear walls, respectively, of the receptacle. The numeral 32 in FIG. 1 designates a hard or permanent seal, i.e., a seal that is not intended to be broken, at the top of the header. Alternatively, the opposed header panels may be formed by folding a piece of film and attaching the ends to the walls of the receptacle. The sealed header 16 preferably has respective tear notches 18 formed on each side edge of the header, where the consumer can initiate tearing off of the sealed header from the package.

It should be appreciated that the front wall of the header 32 and the front wall 12 of the receptacle are shown in FIG. 1 as being made of relatively transparent thermoplastic material. Therefore, the slider-zipper assembly is visible through the clear walls and has not been depicted as hidden.

Figure 2:
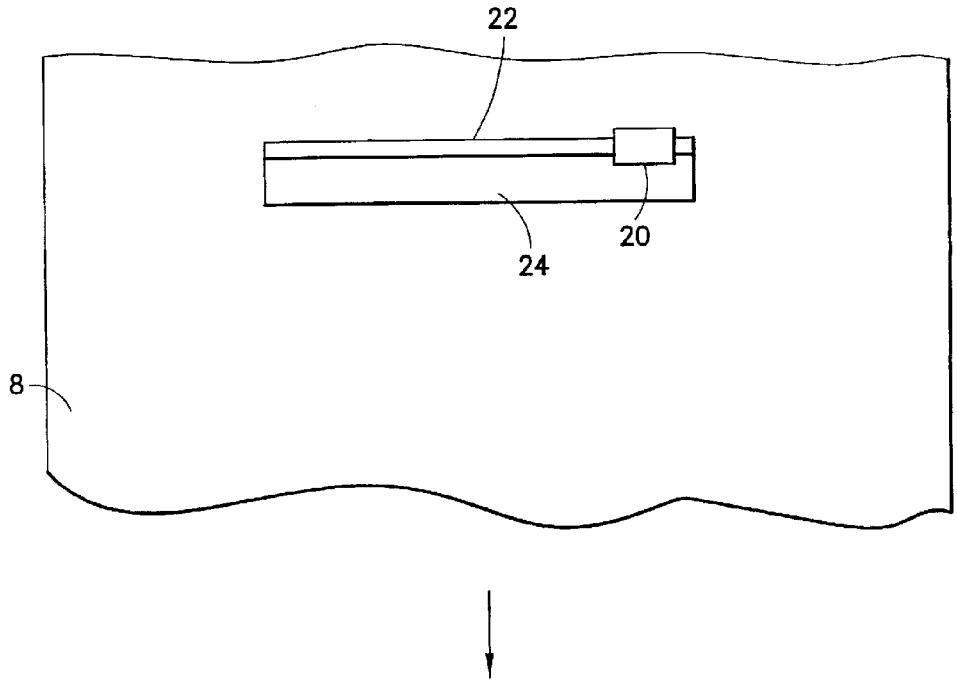
FIG. 2 is a drawing showing a fragmentary top view of a slide-zipper assembly attached to a bag making film and oriented in a transverse direction.

FIG. 2 depicts thermoplastic bag making film 8 with a slider-zipper assembly heat sealed thereon. The slider-zipper assembly comprises a slider 20 and a zipper 22. Preferably the slider-zipper assembly is cut off from the end of a tape or chain of such assemblies and heat sealed to the thermoplastic film using automated equipment. The present invention is directed to providing automated means for guiding and feeding a zipper tape with or without sliders thereon to a zipper tape sealing station.

Figure 3:
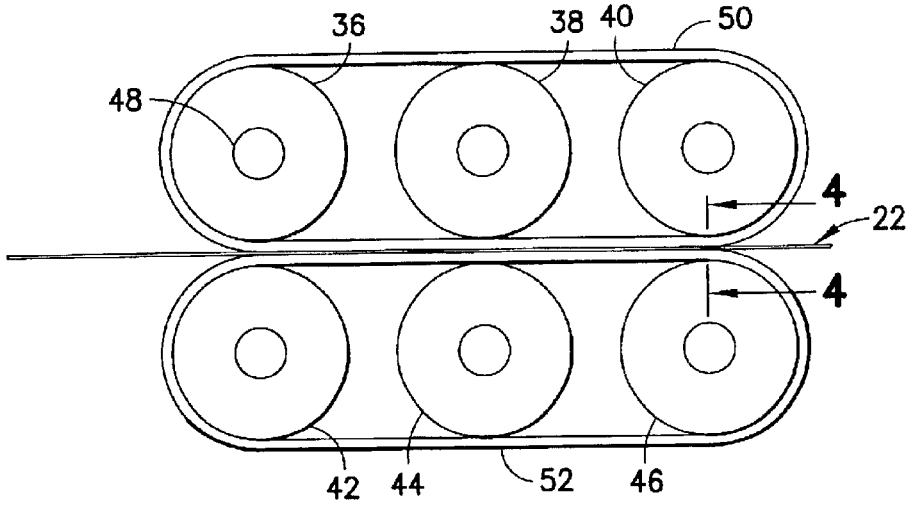
FIG. 3 is a drawing showing a front view of a zipper tape drive assembly for feeding zipper tape in accordance with the disclosed embodiments of the invention.
Figure 4:
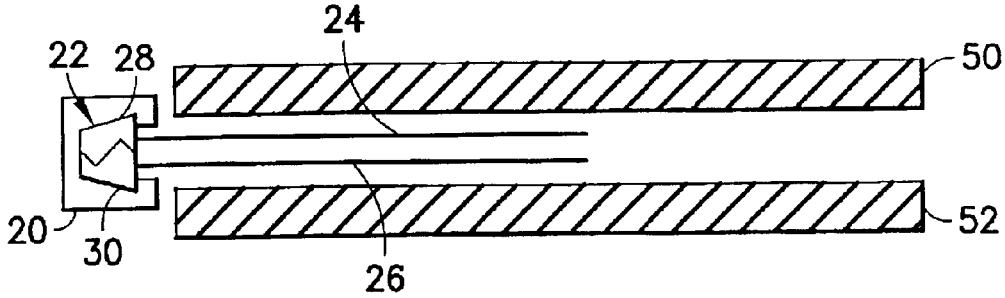
FIG. 4 is a drawing showing the positional relationship of endless belts with an intervening zipper tape with sliders in accordance with one embodiment of the invention. For the sake of clarity, the tape and belts are shown with exaggerated gaps separating them, although in practice the zipper tape and opposing belts are in contact.

In accordance with one embodiment of the invention, the slider-zipper assembly arrives at the position shown in FIG. 2 via the slider-zipper tape drive assembly shown in FIGS. 3 and 4. The assembly comprises a first multi-pulley assembly encased by a first endless belt 50 that circulates around a row of spaced pulleys 36, 38 and 40, and a second multi-pulley assembly encased by a second endless belt 50 that circulates around a row of spaced pulleys 42, 44 and 46. The opposing multi-pulley assemblies are arranged so that the belts 50 and 52 comprise mutually confronting first portions that are in contact. The belts are made of rubber, such as silicone rubber, or some other material having similar strength and elastic properties. The hardness of the belts is preferably in the range of 45–55 durometer. In each assembly, the position of one pulley may be adjustable along the axis of a screw. More specifically, the adjustable pulley is rotatably mounted to an adjustment pulley mount, which translates along the screw axis as the screw is turned. This facilitates the installation and tightening of belts 50 and 52.

Although each assembly in the disclosed embodiment has three pulleys in each row, each row may more generally comprise two or more pulleys and is not limited to three. Preferably, each pulley has the same radius and is mounted to a respective rotatable shaft 48. However, the radii of the pulleys in a given multi-pulley assembly may be different, provided that the confronting portions of the belts, which are tangent to each contacting pulley, are disposed in respective planes. In the disclosed embodiment, the axes of rotation of all the pulleys are mutually parallel, with the axes of rotation of pulleys 36, 38 and 40 being coplanar in a first plane, while the axes of rotation of pulleys 42, 44 and 46 are coplanar in a second plane parallel to the first plane. However, the invention does not preclude one or more additional pulleys in each multi-pulley assembly, which added pulleys support the circulating belts on the return side and are not arranged in the above-described row of pulleys that support the confronting portions of the belts. In this alternative, the pathway followed by each circulating belt would be different than the racetrack shape seen in FIG. 3.

The line 22 in FIG. 3 is intended to generally represent a zipper tape having zipper flanges that intervene between and are in contact with respective mutually confronting second portions of the belts 50 and 52. The detailed structure of the zipper tape, including profiled closure members and sliders mounted thereon, has not been shown in FIG. 3. Additional structural detail will be presented later with reference to FIGS. 4 and 5. The belts 50 and 52 are preferably pressed together as they pass between the opposing rows of pulleys, with at least a portion of the zipper tape, e.g., a pair of zipper flanges, being pressed between the contacting belts.

Still referring to FIG. 3, the endless belts 50 and 52 circulate in opposite directions with at least a pair of zipper flanges intervening between the aforementioned mutually confronting first portions of the belts, and with the aforementioned mutually confronting second portions of the belts in contact with each other. Since the belts circulate in opposite directions, the confronting portions of the belts and the intervening zipper tape with flanges trapped between the belts all move in the same direction, e.g., toward a zipper sealing station where zipper segments are cut and sealed to bag making film. The first multi-pulley assembly (comprising pulleys 36, 38 and 40) is a driven set, while the second multi-pulley assembly (comprising pulleys 42, 44 and 46) is an idler set. Thus, the amount of friction between the contacting portions of the belts and the zipper tape must be sufficient that the belt 50, when driven, will cause the belt 52 also to circulate, with the intervening zipper tape being pushed forward by the forward-moving portions of the belts in contact with the tape.

The first multi-pulley assembly can be driven by a motor (not shown) having an output shaft coupled to the shaft 48 of one of the pulleys 36, 38 or 40. In the case where zipper segments are being fed to a zipper sealing station in a direction transverse to the running direction of the film, a stationary zipper segment will be sealed to a stationary bag making film during the sealing portion of the work cycle, with the tape and film being intermittently advanced during the intervals between sealing operations. Thus, the belt 50 in the disclosed embodiment is driven intermittently rather than continuously. Consequently, the motor is preferably a servomotor or a stepper motor. Each time a new zipper segment is needed at the zipper sealing station, the motor is activated and then controlled to feed the zipper tape forward to the sealing station by a predetermined distance equal to the width of the zipper on a package. Then the motor is turned off. The second multi-pulley assembly is not driven by the motor, but rather is free to circulate in response to a force of friction exerted on the portions of the outer surface of belt 52 that confront the driven belt 50. In the disclosed embodiment, the belt 50 is arranged to circulate along a first pathway comprising a first generally straight path segment, while the belt 52 is arranged to circulate along a second pathway comprising a second generally straight path segment, the belts confronting along these generally straight path segments. These adjacent straight path segments lie parallel and adjacent to each other. The belts 50 and 52 thus move in the same direction along these generally straight path segments during belt circulation, with the zipper tape being carried along with the moving belts.

The dimension of the belts 50 and 52 can be selected to accommodate the type of zipper being used. Also the belts may be provided with relief to accommodate the zipper profiles in cases where the entire zipper tape is sandwiched between the opposing belts. However, in the case of a zipper tape having sliders clipped thereon at spaced intervals along the length of the tape, the entire zipper tape cannot be sandwiched between the belts due to the lack of clearance for the sliders between the contacting belts. In the latter case, the zipper tape with sliders must be set up to have the profiled closure members of the zipper tape and the sliders disposed beyond the edge of the opposing belts.

FIG. 4 shows the positional relationship of the belts 50 and 52 with an intervening zipper tape 22 with sliders 20 (only one slider is shown) in accordance with one embodiment of the invention. For the sake of clarity, the tape and belts are shown with exaggerated gaps separating them, although in practice the zipper tape and opposing belts are in contact. The zipper type comprises profiled closure members 28 and 30, on which sliders 20 are clipped at spaced intervals, and zippers flanges or webs 24 and 26 respectively connected to the profiled closure members 28 and 30. In the illustrated arrangement, the zipper flanges 24 and 26 are sandwiched between and pressed together (again, the pressing together is not shown) by confronting first portions of the belts 24 and 26, while the closure members 28 and 30 with sliders 20 thereon are disposed outside of the belts, running in parallel with the edges of the belts on one side of the belt assembly. It should be noted that the width of the zipper flanges is less than the width of the belts, so that in the zone where the belts confront each other without intervening zipper flanges, confronting second portions of the belts 50 and 52 will be in contact (i.e., the gap depicted in FIG. 4 would in practice not exist). Thus, using the arrangement depicted in FIG. 4, a zipper tape with sliders can be advanced by the friction and compression exerted on the outer surfaces of the zipper flanges 24 and 26 by the belts 50 and 52 respectively.

Figure 5:
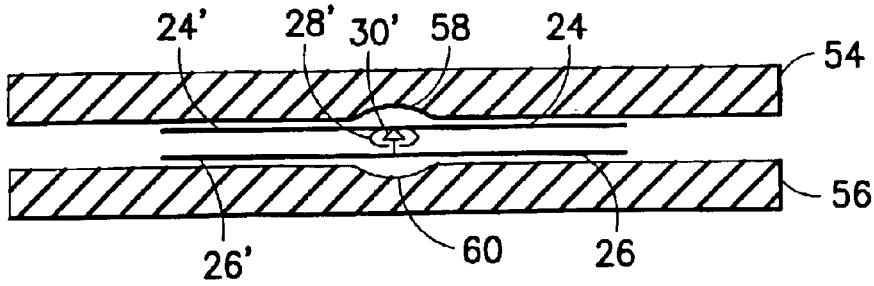
FIG. 5 is a drawing showing the respective positions of the belts of a zipper tape drive assembly relative to an intervening dual-flange zipper tape in accordance with another embodiment of the invention. Again the tape and belts have been shown with exaggerated gaps therebetween for the sake of clarity, whereas in practice these elements are in contact.

As previously mentioned, in cases where the zipper tape being fed has no sliders, the entire zipper tape can be sandwiched between the opposing belts, with the opposing belts being in direct contact to the left and to the right (above and below if the zipper tape were disposed vertically) of the zipper tape. FIG. 5 shows the respective positions of the belts of a zipper tape drive assembly relative to an intervening dual-flange zipper tape in accordance with another embodiment of the invention in which the belts are relieved to accommodate the zipper profile. Again the tape and belts are shown with exaggerated gaps therebetween for the sake of clarity, whereas in practice these elements are in contact. When the belts are pressed together, the opposing zipper flanges will contact each other, forming relatively thin flat structures on opposites sides of the interlocked profiled closure members, while the closure members form a relatively thick structure that can be accommodated by providing relief in the belts.

In accordance with the embodiment depicted in FIG. 5, the zipper feeding apparatus comprises a first belt 54 having an endless recess 58 formed on its outer surface and a second belt 56 having an endless recess 60 formed on its outer surface. The endless recesses 58 and 60 are mutually aligned and mutually opposed in the zone where the belts 54 confront each other to form a relief channel for the relatively thicker portion of the zipper tape where the profiled closure members are disposed. The profile of each recess may be a concavity of curving form, as seen in FIG. 5, or a concavity with triangular, rectangular, trapezoidal or other suitable geometric shape. As the zipper tape and adjoining portions of the belt advance in the direction of the zipper tape sealing station, the profiled portion of the tape is held between the recesses 58 and 60, while the opposing pairs of flanges are compressed between adjoining flat portions of the belts 54 and 56.

Figure 6:
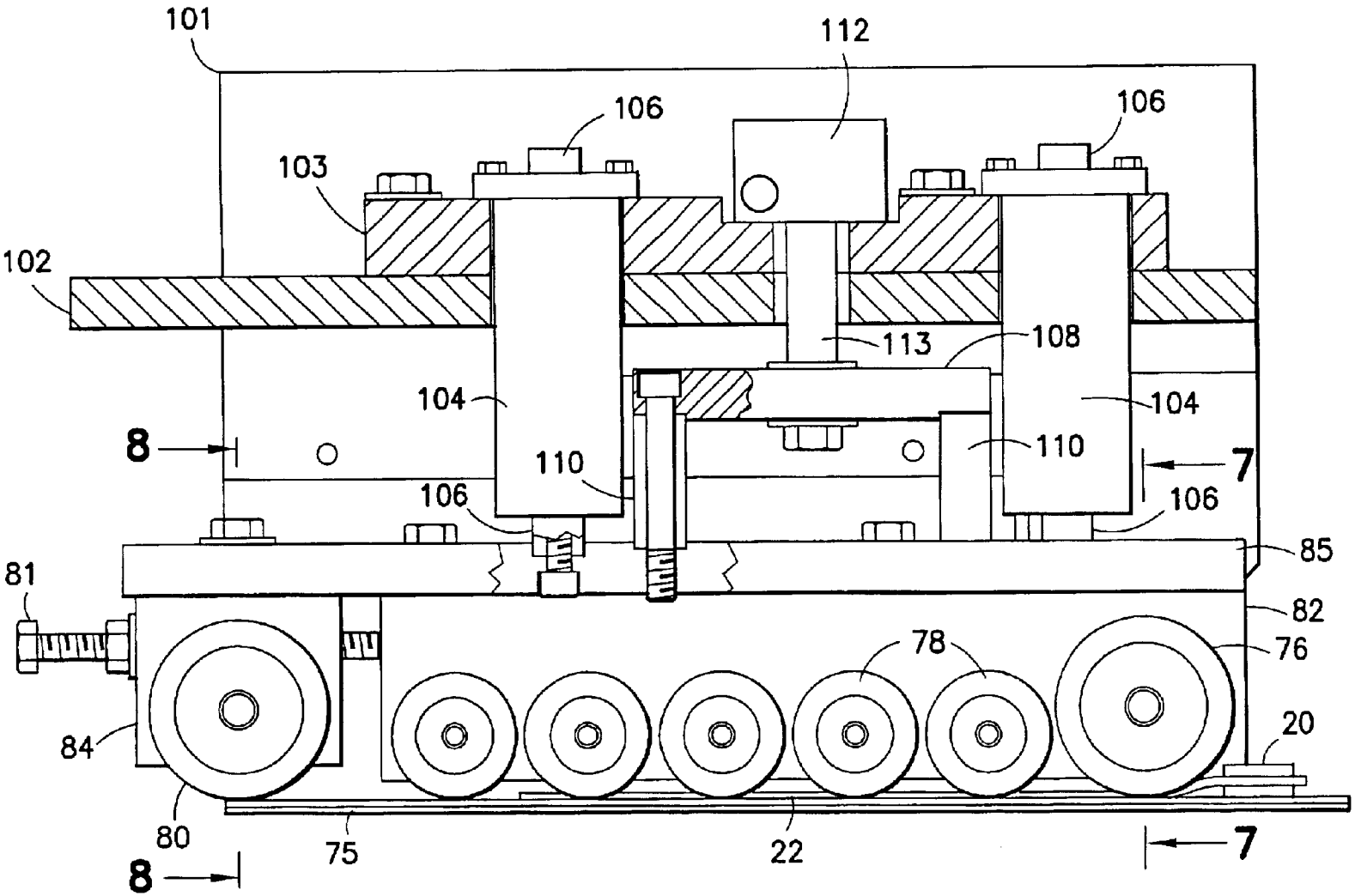
FIG. 6 is a drawing showing a front view of a zipper tape transfer assembly that could be arranged to receive a slider-zipper assembly from the tape drive assembly depicted in FIG. 3.
Figure 7:
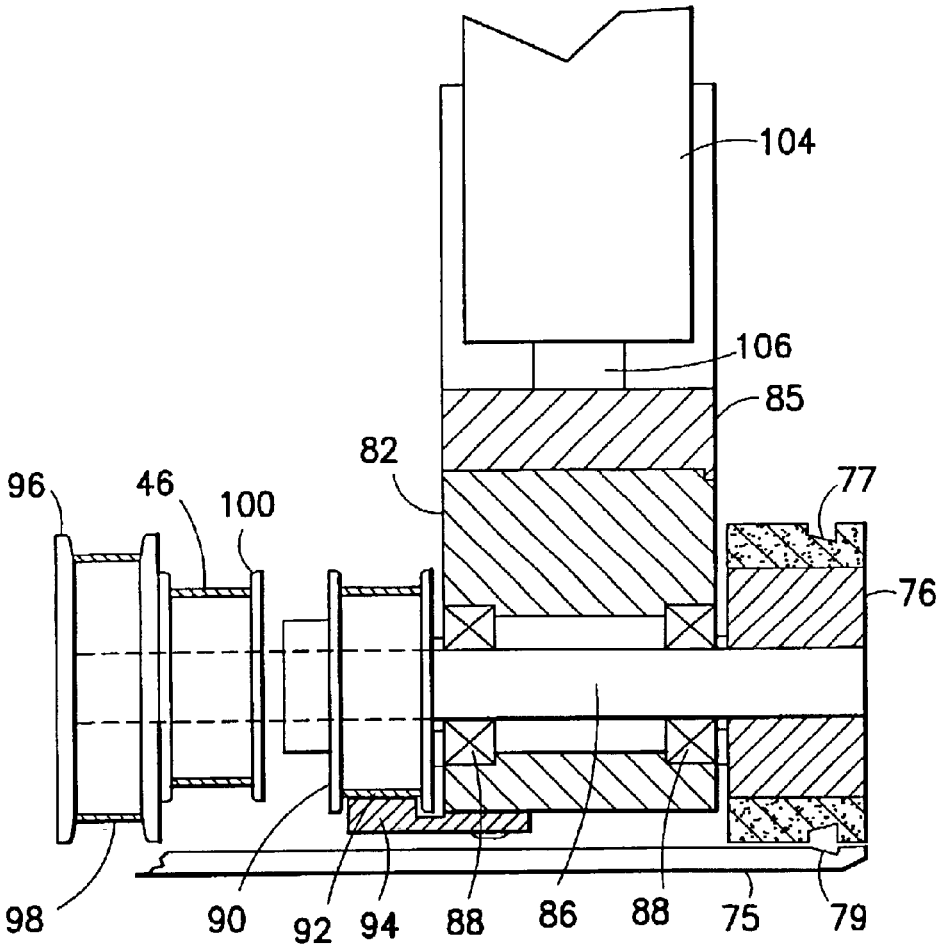
FIG. 7 is a drawing showing a sectional view of the zipper tape transfer assembly depicted in FIG. 6, the section being taken along line 7—7 indicated in FIG. 6.

In the exemplary application of feeding tape to a sealing station, at the same time that the belt drive assembly is pushing the zipper tape toward the sealing station, a tape transfer assembly at the sealing station can be exerting a pulling force on the incoming terminal end of the zipper tape. An exemplary tape transfer assembly is shown in FIGS. 6 and 7. The belt drive assembly remains stationary while the zipper segment at the end of the tape is sealed to the bag making film and cut off. Then the bag making film is indexed in the machine direction one package length and the zipper tape (with or without sliders) is indexed in the transverse direction one zipper length, following which the sealing and cuffing operations for application of the next zipper segment are repeated.

In the front view presented in FIG. 6, the terminal end of the zipper tape is shown in a position between a bank of drive roller assemblies 76, 78, 80 and a fixed shelf 75. The slider 20 of the terminal zipper length sits atop the shelf 75 at a position to the right of the large drive roller 76. The slider cannot pass under the drive rollers. It should be appreciated that the zipper tape extends in the right-hand direction, where it passes through the previously described belt drive assembly. The zipper tape enters the tape transfer assembly from right to left in FIG. 6. In the position shown in FIG. 6, the zipper tape is cut and the cut zipper segment is sealed to bag making film that passes directly below the shelf 75. The cutting and sealing mechanisms are not shown.

As seen in FIG. 7, the shelf has a V-shaped longitudinal groove 79, while the large drive roller assembly 76 has a circumferential groove 77 with a generally trapezoidal profile. Each of small drive rollers 78 has a similar circumferential groove. These circumferential grooves on the drive roller assemblies are generally aligned with the longitudinal groove 79 of the shelf 75. At the nip where each drive roller nearly contacts the shelf 75, the peripheral grooves 77 and the longitudinal groove 79 form respective passageways for, in this example, an A-shaped zipper profile. Although not shown in FIG. 7, the flanges of the zipper extend rightward, through the gap between the shelf and roller 76 and beyond the edge of the shelf, where the bottom flange will be sealed to the bag making film.

Still referring to FIG. 7, the drive roller assembly 76 comprises a metal core surrounded by an annular ring made of silicone. The circumferential groove is formed in the annular ring of silicone. The other drive roller assemblies (i.e., items 78 and 80) have a similar construction. The metal core of the drive roller 76 is mounted to one end of a horizontal shaft 86. The shaft 86 is rotatably supported by a pair of bearings 88. The bearings 88 are mounted in a pulley mounting plate 82. The other drive assemblies are also mounted to the end of respective horizontal shafts rotatably supported by respective sets of bearings mounted in the pulley mounting plate 82. Shaft 86, however, differs from the other shafts in that shaft 86 is longer and carries, on its opposite end, a gearbelt pulley 96 that is coupled to a servomotor (not shown) by a gearbelt 98 and a gearbelt pulley 100 that is coupled to a gearbelt pulley (not shown) of the belt drive assembly by a gearbelt 46. The servomotor drives the rotation of shaft 86 and drive roller assembly 76 mounted thereon. The rotation of shaft 86 in turn drives the circulation of the driven belt in the belt drive assembly. A programmable logic controller controls the hardware so that the sealing operation and the zipper tape advancement occur during different parts of the work cycle.

The rotation of shaft 86 also drives the rotation of the other drive roller assemblies 78 and 80 of the tape transfer assembly. As seen in FIG. 7, a gearbelt pulley 90 is mounted on shaft 86. The gearbelt pulley 90 and the drive roller assembly 76 are mounted on shaft 86 on opposite sides of the pulley mounting plate 82. Similarly, the other shafts, on which the other drive roller assemblies 78 and 80 are mounted, also have gearbelt pulleys aligned with gearbelt pulley 90 and coupled to gearbelt pulley 90 by means of a gearbelt 92. The gearbelt 92 is retained against the gearbelt pulley 90 by a belt retainer 94. Moreover, each gearbelt pulley driven by gearbelt 92 also has a respective belt retainer (not shown).

The peripheral surface of each drive roller is made of silicone to prevent slippage of the plastic zipper tape during transfer of the zipper tape in a direction transverse to the running direction of the bag making film. The non-slipping contact of the periphery and groove of the drive rollers with the zipper tape during roller rotation in a clockwise direction (as seen in FIG. 6) pulls the zipper tape from right to left in FIG. 6. As previously described, the tape transfer assembly shown in FIG. 6 applies force to the terminal section of the zipper tape while the belt drive assembly shown in FIG. 3 applies force to a trailing intermediate section of the zipper tape, these assemblies working concurrently and being driven by the same servomotor. In the case where the zipper tape has sliders clipped thereon, transverse transfer of the zipper tape is stopped before the slider 20 contacts drive roller assembly 76. In this position, the zipper tape is cut and sealed to the bag making film.

After each slider-zipper assembly has been attached to the bag making film along a line transverse to the running direction of the film, the film with slider-zipper assembly must be advanced by one package length. With reference to the drawings, the bag making film will be advanced in a direction directed out of the page in FIG. 6 and from left to right in FIG. 7. However, as seen in FIG. 7, the opposing grooves 77 and 79 form a passageway for receiving an A-shaped zipper profile while the gap to the right, through which the zipper flanges project, is too narrow to allow the A-shaped zipper profile to pass through during film advancement. This problem is solved by providing a tape transfer assembly in which the drive roller assemblies can be lifted upward and away from the stationary shelf 75.

Although FIG. 7 does not show the zipper, the person skilled in the art will readily understand that the zipper profile will be captured between grooves 77 and 79 and the zipper flanges will extend to the right, through the gap between drive roller assembly 76 and shelf 75. After the bottom zipper flange has been sealed to the top of the bag making film, which passes under shelf 75, the carriage is lifted and then the bag making film is advanced to the right in FIG. 9. When the drive roller assembly 76 is raised, groove 77 no longer interferes with rightward movement of the zipper profile as the bag making film (which the zipper is now attached to) moves to the right. Also, the groove 79 in shelf 75 is formed with a surface that is inclined to facilitate the zipper profile leaving groove 79 without the lower lip of the zipper profile catching in the groove. After the bag making film has been advanced one package length, the carriage is lowered and the next zipper length is pulled into the flange sealing position by the drive roller assemblies.

Means other than a gearbelt can be used to couple the belt drive assembly to the tape transfer assembly. For example, the tape drive and tape transfer assemblies could be driven by separate motors, operation of the motors being synchronized by a programmable controller.

While the invention has been described with reference to preferred embodiments, it will be understood by those skilled in the art that various changes may be made and equivalents may be substituted for members thereof without departing from the scope of the invention. In addition, many modifications may be made to adapt a particular situation to the teachings of the invention without departing from the essential scope thereof. For example, it should be obvious that the slider guide may be formed as a monolithic piece or may be an assembly having two or more parts. Therefore it is intended that the invention not be limited to the particular embodiment disclosed as the best mode contemplated for carrying out this invention, but that the invention will include all embodiments falling within the scope of the appended claims.

What is claimed is:

1. An apparatus comprising first and second multi-pulley assemblies, said first multi-pulley assembly comprising a first pulley, first and second belts respectively encasing said first and second multi-pulley assemblies and comprising mutually confronting portions, means for driving rotation of said first pulley, said first and second belts circulating in opposite directions when said first pulley is driven to rotate, a sealing station comprising a heat sealing mechanism and a cutting mechanism, and a zipper tape comprising a portion that is pressed between said confronting portions of said first and second belts after a first amount of rotation of said first pulley and disposed at said sealing station after a second amount of rotation of said first pulley subsequent to said first amount of pulley rotation, said zipper tape portion being moved lengthwise during said second amount of pulley rotation and then being heat sealed to bag making film by said heat sealing mechanism and severed from a remainder of said zipper tape by said cutting mechanism while said zipper tape portion is disposed at said sealing station.

2. The apparatus as recited in claim 1, wherein respective first portions of said first and second belts are in contact with each other, while respective second portions of said first and second belts are in contact with said zipper tape.

3. The apparatus as recited in claim 1, wherein said first and second belts are made of rubber.

4. The apparatus as recited in claim 1, wherein said first multi-pulley assembly is a driven set and said second multi-pulley assembly is an idler set.

5. The apparatus as recited in claim 1, wherein said first belt comprises a first endless recess on its outer surface and said second belt comprises a second endless recess on its outer surface, said first and second endless recesses being aligned and in mutual opposition along said confronting portions of said first and second belts to form a relief channel for a relatively thicker portion of the zipper tape.

6. The apparatus as recited in claim 1, wherein said first multi-pulley assembly further comprises a second pulley, said first and second pulleys having mutually parallel axes of rotation and connected by said first belt; and wherein said rotation driving means comprise a motor coupled to said first pulley to drive said first pulley to rotate.

7. The apparatus as recited in claim 6, wherein said second multi-pulley assembly comprises third and fourth pulleys having axes of rotation substantially parallel to the axes of rotation of said first and second pulleys and connected by said second belt, wherein said third and fourth pulleys are idler pulleys.

8. An apparatus comprising:

first and second circulating belts, said first belt being arranged to circulate along a first pathway comprising a first generally straight path segment, and said second belt being arranged to circulate along a second pathway comprising a second generally straight path segment, wherein said first and second generally straight path segments lie parallel and adjacent to each other, said first and second belts moving in the same direction along said first and second generally straight path segments during belt circulation;

means for driving said first and second circulating belts to circulate;

a sealing station comprising a heat sealing mechanism and a cutting mechanism; and a zipper tape comprising first and second profiled closure members that are interlocked to each other, and first and second zipper flanges respectively connected to said first and second profiled closure members, said first and second zipper flanges confronting each other and being in respective contact with said first and second belts, wherein said first and second circulating belts cause a portion of said zipper tape pressed therebetween to move lengthwise in said same direction to a position at said sealing station, said zipper tape portion being heat sealed to bag making film by said heat sealing mechanism and severed from a remainder of said zipper tape by said cutting mechanism while said zipper tape portion is disposed at said sealing station.

9. The apparatus as recited in claim 8, wherein said first belt comprises a first endless recess on its outer surface and said second belt comprises a second endless recess on its outer surface, said first and second endless recesses being aligned and in mutual opposition along said first and second generally straight path segments, and said first and second profiles closure members along said pressed portion of said zipper tape being disposed in a relief channel formed by said first and second endless recesses.

10. The apparatus as recited in claim 8, wherein said first and second profiled closure members are not pressed between said first and second belts.

11. The apparatus as recited in claim 10, further comprising a multiplicity of sliders mounted to said zipper tape at spaced intervals therealong.

12. An apparatus comprising:

first and second belts arranged with respective portions confronting each other, each of said first and second belts having a respective endless groove formed therein, said endless grooves being aligned with and confronting each other along said confronting portions of said first and second belts, thereby forming a passageway;

means for driving said first and second belts to circulate;

a sealing station comprising a heat sealing mechanism and a cutting mechanism; and a plastic zipper tape comprising first and second profiled closure members that are interlocked to each other and aligned with and disposed within said passageway, wherein said first and second circulating belts cause a portion of said zipper tape that was disposed within said passageway to move lengthwise to a position at said sealing station, said zipper tape portion being heat sealed to bag making film by said heat sealing mechanism and severed from a remainder of said zipper tape by said cutting mechanism while said zipper tape portion is disposed at said sealing station.

13. The apparatus as recited in claim 12, wherein said zipper tape further comprises a first zipper flange connected to said first profiled closure member and a second zipper flange connected to said second profiled closure member, said first and second zipper flanges confronting each other, respective portions of said first and second zipper flanges being disposed between respective adjoining portions of said first and second belts in a first zone adjacent to and on one side of said passageway.

14. The apparatus as recited in claim 13, wherein said zipper tape further comprises a third zipper flange connected to said first profiled closure member and a fourth zipper flange connected to said second profiled closure member, said third and fourth zipper flanges confronting each other, respective portions of said third and fourth zipper flanges being disposed between respective adjoining portions of said first and second belts in a second zone adjacent to and on the other side of said passageway.

15. The apparatus as recited in claim 12, wherein said first and second belts are made of rubber.

16. The apparatus as recited in claim 12, wherein respective first portions of said first and second belts are in contact with each other, while respective second portions of said first and second belts are in contact with said zipper tape.

17. A method of feeding zipper tape comprising the following steps:

arranging first and second belts for circulation along first and second paths respectively, respective mutually opposing first portions of said first and second belts being in contact along a generally straight path segment;

placing first and second portions of a zipper tape between mutually opposing second portions of said first and second belts, said first and second portions of said zipper tape being disposed parallel to said generally straight path segment, said first portion of said zipper tape being in contact with said second portion of said first belt, and said second portion of said zipper tape being in contact with said second portion of said second belt; and driving said first belt to circulate in a predetermined direction with sufficient friction between said first belt and contacting portions of said zipper tape and said second belt that said second belt circulates in a direction opposite to said predetermined direction and said zipper tape is advanced.

18. The method as recited in claim 17, further comprising the step of inserting a multiplicity of sliders onto said zipper tape at spaced intervals therealong.

19. The method as recited in claim 17, wherein said driving step is performed intermittently during spaced time intervals, further comprising the steps of:

stopping said zipper tape after each advance of a predetermined length;

attaching each successive segment of said zipper tape to bag making film while said zipper tape is stopped;

severing each of said successive zipper tape segments from the remainder of said zipper tape; and advancing said bag making film after each attachment step so that said severed zipper tape segments are attached at spaced intervals along said bag making film.

* * * * *